United States Patent [19]

Penicaut et al.

[11] Patent Number: 4,819,403

[45] Date of Patent: Apr. 11, 1989

[54] METHOD FOR INSTALLING ELEVATOR DOORS

[75] Inventors: Alain M. R. Penicaut, Paris; Jean C. Chapelain, Sainte Genevieve, both of France

[73] Assignee: Otis Elevator Company, Farmington, Conn.

[21] Appl. No.: 62,989

[22] Filed: Jun. 17, 1987

[30] Foreign Application Priority Data

Sep. 11, 1986 [FR] France ..... 8612714

[51] Int. Cl.[4] ..... E04B 1/00

[52] U.S. Cl. ..... 52/741; 52/30; 33/407; 33/194

[58] Field of Search ..... 52/741, 30; 33/407, 33/404, 194; 49/506

[56] References Cited

U.S. PATENT DOCUMENTS

| | | | |
|---|---|---|---|
| 2,969,595 | 1/1961 | Songer | 33/407 |
| 2,991,557 | 7/1961 | Bongiovanni | 33/407 |
| 3,015,890 | 1/1962 | McCaskill | 33/407 |
| 3,740,907 | 6/1973 | Loomis | 52/30 X |
| 3,984,952 | 10/1976 | Loomis | 33/404 X |
| 4,530,189 | 7/1985 | Randall | 52/30 |

*Primary Examiner*—Carl D. Friedman

[57] ABSTRACT

A method is disclosed for installing a hall door assembly on a floor when the elevator rails or car are not installed. A template is placed at one terminal or end of the elevator shaft and is used to locate the position of a temporary bracket containing three holes which are spaced apart to correspond with three marks along the sill of the hall door assembly. The holes are on a common line and at a preestablished distance from the wall of the shaft. Once this bracket is installed in the shaft, a plumb line is extended from each of the holes to another bracket below. The plumb lines hang next to the floor on which a hall door is to be installed. This other bracket is positioned so that the plumb line passes through the center of a corresponding hole in the bracket. A door alignment tool is positioned between the sill of the door and each of the plumb lines, and the thickness of the tool, which defines the proper setback distance between the door and the plumb lines, establishes the alignment distance between the door and the edge of the shaft. The tool is used in this manner with each plumb line and on each floor for the door assembly thereon, the installation process provides correct orientation of the door sill relative to the lines and thereby also the correct orientation relative to the template, which is keyed to location of the elevator rails or the car which are subsequently installed. After the door is plumbed to the floor, it is permanently attached to the floor and walls of the building.

7 Claims, 3 Drawing Sheets

METHOD FOR INSTALLING ELEVATOR DOORS

TECHNICAL FIELD

This invention relates to installing the hall or floor sliding doors in an elevator system.

BACKGROUND ART

Following current, common practice, installation in a building of elevator hall sliding doors, which may be center or side opening doors, begins with the installation of the drive in the machine room, which may be on the top, side or bottom of the shaft. Then the elevator guide rails are installed by using a template, which is temporarily placed in the shaft, to align the rails relative to the drive. Using the elevator rails and another template, the hall door, on each floor or landing, is installed by aligning it with location marks on the template. The template establishes the proper position between the hall door and the rail. The proper relationship between the hall doors and the elevator car, which is subsequently assembled in the hoistway, is thus achieved. Of course, it is possible to assemble the elevator car prior to the installation of the hall doors and then install and align the hall doors by positioning the elevator car at each floor, a more expensive and complex procedure.

It should be observed that the conventional type of installation procedure may only be used in a fully completed building, one in which the floors are substantially in final form and the machine room is available for the installation of the drive. This can have an economic impact in that the building can not be partially occupied. In many constuction projects, partial use of the building on the lower floors is possible, and it is often desired to accelerate building occupancy, to reduce construction costs. But to achieve that, the shaft opening, the path between the floor and the shaft, must be closed off, and while this can be done roughly, it is better if the actual elevator hall doors are installed in the final finished position (correctly aligned for the car door drive and coupling) so that the hallway can be finished.

Among the objects of the present invention is to provide an inexpensive, simple and reliable way to install the elevator hall doors during the early construction of the building. A concomitant object is to make it possible to install the elevator hall doors in their final position during the construction of the elevator system, to permit early occupancy of at least a portion of the building. Furthermore, to the extent that it can be possible to install the elevator drive but not all of the rails, an object of the present invention is to permit the installation of the elevator car and the hall doors during the construction of an elevator building so that at least some of the floors, those that are finished, may be reached with the elevator car.

DISCLOSURE OF INVENTION

According to the invention, the hall door on a floor, the "installation floor", is positioned by referencing a plurality of plumb lines that hand down the shaft, passing by the door opening. The setback, a desired distance between the door and the shaft, is measured from the plumb lines. Each line corresponds to a point on the door, e.g. the sill, which should be opposite the line when the door is in position. When the setback for each point is the same and the lines and the points are opposed, the door frame is permanently attached to the hall wall.

According to one aspect of the invention, the lines hang down from a bracket that is positioned on the shaft wall through the use of a template that is marked to identify the correct location for the bracket for the location of the rails, which are installed, along with the elevator car, after the hall door is installed. The lines hand down the interior of the shaft from this bracket to another bracket, lower in the shaft, this lower bracket contains a hole to receive each line.

According to another aspect of the invention, a the lower backet is installed in the shaft at a position below the installation floor, by using a template that fits into the shaft and that is keyed to the eventual rail position. Using the template, the correct position the lower bracket is found and the bracket is then attached to the shaft wall. The lower bracket contains a hole for each plumb line. The lines are then suspended from another bracket, and that bracket is placed on the shaft wall at the location at which each plumb line hangs through the center of its corresponding hole in the lower bracket. The spacing between the lines corresponds to the spacing between the centers of those holes, and the centers are on a line that defines the setback.

Other objects, benefits and features of the invention will be discernible from the drawings and description of the best mode for carrying out the invention that follow.

BEST MODE FOR CARRYING OUT THE INVENTION

Figure 1:
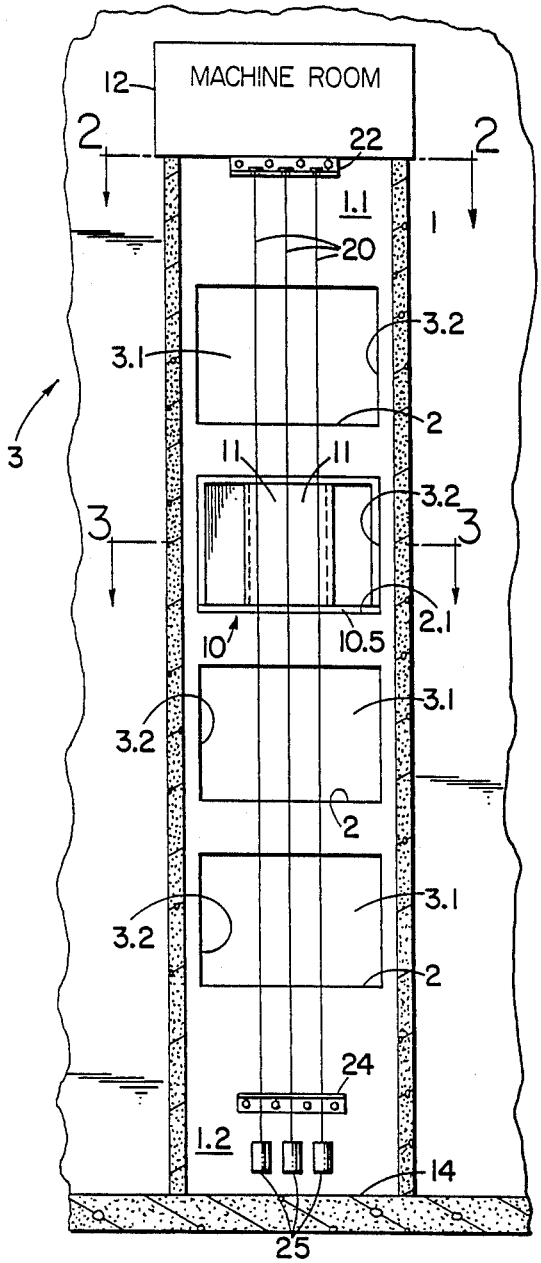
FIG. 1 is a simplified elevational view of an elevator shaft with several floors or landings.

The elevator shaft 1 shown in FIG. 1 connects a plurality of floors or landings 2 in a building 3 and on one floor 2.1, the installation floor, an elevator hall door assembly 10 is shown that contains a pair of center opening doors 11. A machine 12 is located at the top of the shaft to contain an elevator traction drive motor. The full elevator system, such as rails, counterweight and drive, are not shown because the invention is directed at installing one or more of the sliding doors 11 before those components are installed. Certain aspects of the traditional traction elevator have been omitted because the invention is concerned with the installation of the hall doors before any other elevator components are installed. In the fully assembled elevator system, a motor is placed in the machine room and cables extend up and down the shaft between the elevator car and counterweight. These components, as well as others, such as the car and counterweight rails and the hall buttons, are not shown. In some elevator systems, mostly hydraulic elevators, the machine room is located in the pit area 14. In some traction elevator systems, the pit for the drive may be on the side of the shaft, either at the top or the bottom of the shaft. Regardless of the type of drive, traction or hydraulic, the invention may be used to install the doors as soon as there is a shaft area (part of, but not necessarily the entire shaft) adjacent some floors, which would be the situation in a partially finished building. Relating that to the depiction in FIG. 1, there the entire shaft and machine room are completed, but it can be imagined that the machine room and some of the upper floors are not finished. The invention makes it possible to install the door in such a "partially completed" building.

Figure 2:
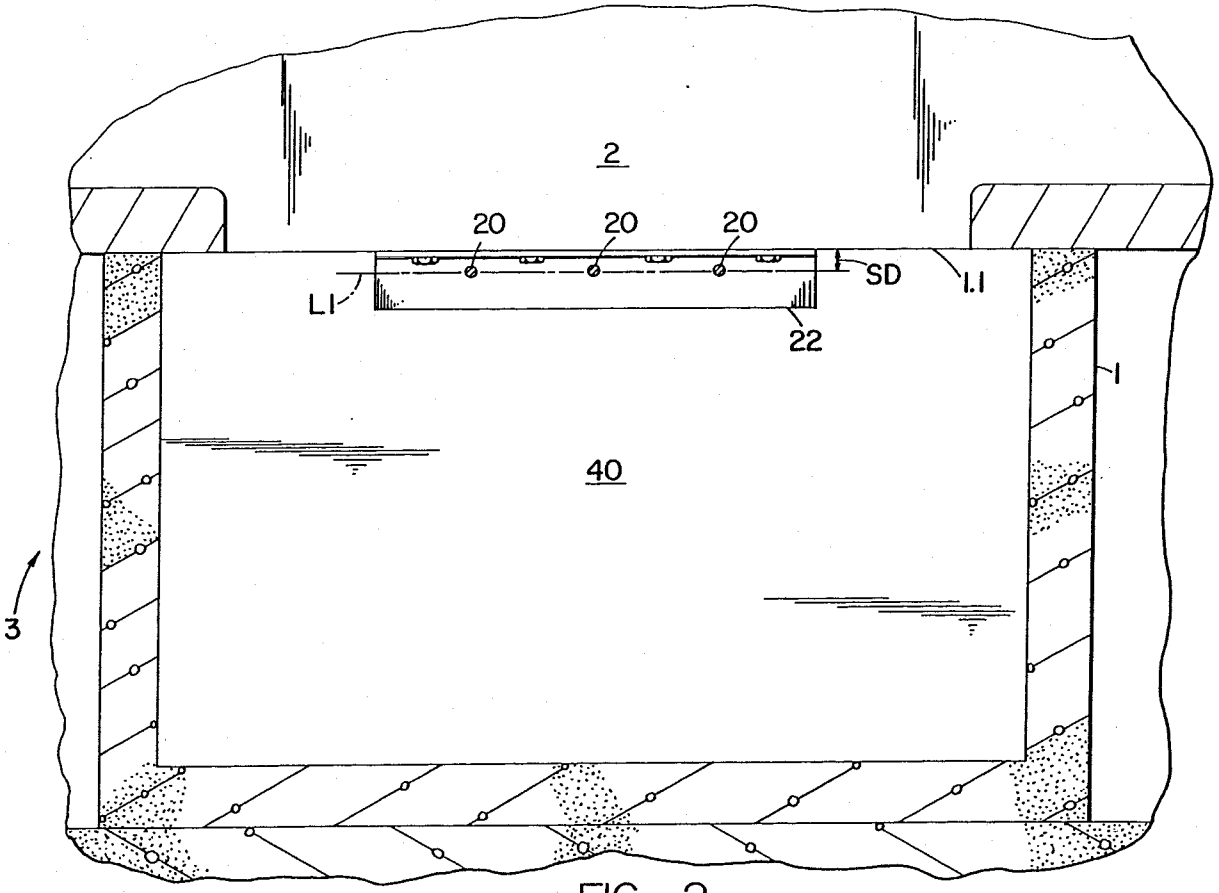
FIG. 2 is a plan view of an elevator shaft as seen along the line 2—2 in FIG. 1.
Figure 3:
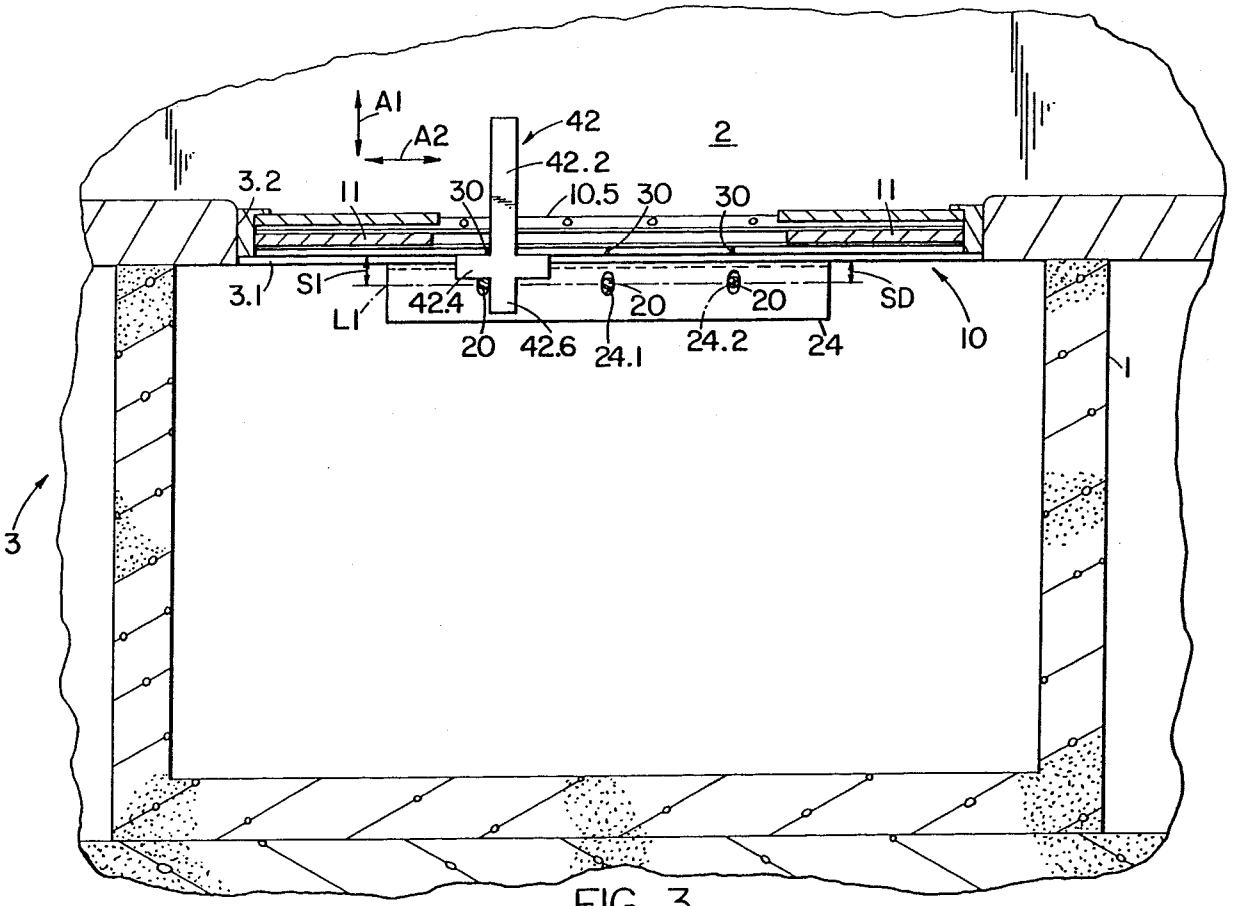
FIG. 3 is a plan view of an elevator shaft as seen along the line 3—3 in FIG. 1.

In FIG. 1, three plumb lines 20 hang down the shaft, passing by each floor. FIG. 2 shows that the lines are attached by a line suspension bracket 22 (an upper bracket) to the shaft wall 1.1 just below the floor of the machine room, so that the bracket can be reached from the machine room. The lines extend from the line suspension bracket 22 to a "line retention" bracket 24 (a lower bracket), and that bracket 24, FIG. 3 shows, is attached to the shaft at a point below the installation floor, specifically on the wall of the sit at position 1.2. FIG. 3 shows that the line retention bracket 24 contains a slot 24.1, much wider than each one of the lines, to receive one plumb line 20. Each plumb line is pulled taut by a weight 25 in the pit.

The three lines 20 are spaced apart in a preset (preestablished) pattern defined by the line attachment points on the line suspension bracket 22, and the centers of the slots 24.1 duplicate that pattern, which consists of three points equidistant from each other and on a common line L1. This line L1 defines "setback," a predetermined distance or spacing, shown in FIG. 3 as SD, between the shaft wall and each line. The distance SD is keyed to the proper setback distance between the shaft side of the door and the car door, is installed in the elevator shaft as subsequently described. In a rather typical arrangement, the car and hall doors are coupled together when the car approaches a floor; the car door opens and closes the hall door. The setback must be correct to provide the running clearance, the spacing between the car and hall door, needed for reliable and smooth door operation.

It can be seen from FIGS. 1, 2 and 3 that the lines thus establish a "vertical plane" that extends down the shaft at a uniform distance (set back) from the shaft wall. This plane is colinear with the line L1 and is at the distance SD from the shaft wall. Each of the lines corresponds to a particular mark or location point 30, which, in this particular embodiment, is a notch on the door sill 10.5.

The line suspension or upper bracket 22 is first located through the use of a template 40, which, as FIG. 2 shows, is placed in the shaft at the machine room. The template is keyed to the dimensions of the shaft and identifies the correct location on the shaft wall for the upper bracket 22. With the template in place, the bracket is bolted (so that it can be later removed) in place on the wall in a perfectly level position. The template contains suitable markings to locate the proper horizontal position of the bracket, and, in this depiction, it can be assumed that the marking follows the contour of the bracket to define, if the bracket were not in place, a rectangle with the same plan dimensions as the bracket. The upper bracket 24 is then attached to the wall at a precise position at which each line passes through the approximate center 24.2 of each slot.

The hall door is put into a "rough" position in the opening 3.1 between the hall and the shaft and vertically held in place on adjustable brackets that are screwed into the walls 3.2 that surround the opening. Those brackets are not shown. While the particular sequence of events in aligning the door using the lines is not especially critical, the overall object is to move the door back and forth in directions A1 and A2 until each mark 30 and its asssociated plumb line are directly opposed and each line is at a distance S1 from the door sill. Then the door is plumbed level using a level or plumb line a procedure that ensures that the balance of the door (above the sill) is at the setback distance, or, to put another way, parallel to the plane defined by the lines 20.

FIG. 3 shows that the setback distance can be conveniently be measured by using a special cross-like calibrated tool 42 that functions as both a rule and t-square. This tool has a handle 42.2, an alignment section 42.4, and a spacer section 42.6. Each edge of the handle and the spacer section are colinear; the alignment section is perpendicular to both. The tool is "run across" the sill from line to line. The handle is placed with one of its edges directly over the mark 30 and the door is shifted so that the line 20 just touches the intersection between the spacer alignment sections, as shown. The tool may be used from either side of a line, because it is symmetrical (its right and left sides are identical, as FIG. 3 shows).

In a variation of the invention that is especially useful when only the first few floors are finished enough for occupancy and final completion and decorating, the plumb lines 20 are installed by first positioning the lower bracket 24 in place in the pit area by using a template to locate its correct horizontal position on the wall of the pit area. Then the lines are hung from the upper bracket 22 in the machine room and the bracket 22 is attached at a location at which each of the lines is at the slot centers in the lower bracket. As more floors are added to the building, the lines are extended up the shaft by moving the upper bracket 22 to another point at which they hand down directly through the center of the slots 24.2. Spacers may be required to adjust the elevation of the bracket 22 from the shaft wall to achieve that relationship between the lines and the retention bracket, mainly because the shaft surface may be irregular.

With the benefit of the previous descriptions and explanations of the invention, and its objects, benefits and features, one skilled in the art to which the invention relates may be able to make modifications and variations to the invention, in whole or in part, without departing from its true scope and spirit.

We claim:

1. A method for installing an elevator hall door in a space connecting a first floor and the elevator shaft in a building having a plurality of floors adjacent the shaft, the door having a horizontal surface characterized by the steps of:

a. placing alignment marks along a horizontal surface on the door;

b. suspending in the shaft and from a location one or more floors away from the first floor, a plurality of spaced apart plumb lines that are colinear on an imaginary straight line that is at a reference distance, common to each floor, for adjusting the distance between the elevator hall door and the shaft, each plumb line corresponding to an alignment mark on the hall door, the placement of the lines being based on the dimensions of the shaft and the intended location of the car that is to be installed in the elevator shaft after the elevator hall door is installed;

c. placing the elevator hall door on the first floor in a position opposite the plumb lines and adjusting the position of the elevator hall door relative to the lines so that each line is opposite its corresponding mark on the door and each line is the same distance from its corresponding mark and then attaching the door to the building.

2. A method according to claim 1, characterized in that step b. comprises:

placing a template in the shaft at a location above the first floor for the purpose of locating a line suspending bracket which is attached to the shaft wall the plumb lines being suspended from said bracket.

3. A method according to claim 2, characterized by the additional step of:

d. attaching a line retainer bracket on the shaft wall at a location below the first floor, the line retainer bracket having an individual hole to receive each line and being located on the shaft wall by adjusting its position so that each line passes through the center of its associated hole in the line retainer bracket, the individual holes being on a horizontal line that is at a setback distance between the lines at the line suspending bracket, said setback distance being the horizontal distance between said horizontal line and the first floor.

4. A method according to claims 1, 2, or 3, characterized in that step c. comprises:

positioning the door by placing a spacer between each line and the elevator hall door, the spacer being configured to register with a straight surface on the elevator hall door and to extend perpendicularly from the elevator hall door towards one of the plumb lines, said surface traversing the opening and paralleling said first floor.

5. A method according to claim 1, characterized in that the step b. comprises the steps:

installing a line retainer bracket on the shaft wall at a position below the first floor the line retainer bracket containing a plurality of holes on an imaginary straight line and spaced apart at the desired spacing between the plumb lines; and installing a line suspending bracket at a location in the shaft above the floor and at a position at which each plumb line extends through its corresponding hole in the line retainer bracket, the plumb lines being suspended from locations on the line suspending bracket that correspond to the location of the holes in the line retainer bracket.

6. A method according to claim 5, characterized in that step b. comprises the step:

placing a template in the shaft to locate the correct position for the line retainer bracket, the template containing markings to indicate the correct location of the line retainer bracket for the intended location of the elevator rails or car that are to be installed in the shaft after the hall door is installed.

7. A method according to claim 5 or 6 characterized in that step c. comprises:

positioning the door at a setback distance distance by placing a spacer between each line and the door, the spacer being configured to register with a horizontal surface on the door and to extend perpendicularly from the door towards the line.

* * * * *